US007469988B2

(12) United States Patent
Endo

(10) Patent No.: US 7,469,988 B2
(45) Date of Patent: Dec. 30, 2008

(54) LIQUID EJECTING APPARATUS

(75) Inventor: Tsunenobu Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 514 days.

(21) Appl. No.: 11/357,589

(22) Filed: Feb. 17, 2006

(65) Prior Publication Data

US 2006/0187265 A1 Aug. 24, 2006

(30) Foreign Application Priority Data

| | | |
|---|---|---|
| Feb. 21, 2005 | (JP) | 2005-044239 |
| Feb. 22, 2005 | (JP) | 2005-046269 |
| Jan. 17, 2006 | (JP) | 2006-009143 |
| Jan. 17, 2006 | (JP) | 2006-009144 |

(51) Int. Cl.
*B41J 2/165* (2006.01)

(52) U.S. Cl. ..... 347/36; 347/76

(58) Field of Classification Search ..... 347/36, 347/76

See application file for complete search history.

(56) References Cited

U.S. PATENT DOCUMENTS

| | | | | |
|---|---|---|---|---|
| 2003/0151639 | A1 | 8/2003 | Takahashi | |
| 2004/0125154 | A1 * | 7/2004 | Cheney et al. | 346/35 |

FOREIGN PATENT DOCUMENTS

| | | | |
|---|---|---|---|
| EP | 1 433 612 | A1 | 6/2004 |
| JP | 11-320891 | | 11/1999 |
| JP | 2000-141705 | | 5/2000 |
| JP | 2001-047643 | | 2/2001 |
| JP | 2001-105626 | | 4/2001 |
| JP | 2001-232817 | | 8/2001 |
| JP | 2001-334688 | | 12/2001 |
| JP | 2002-301832 | | 10/2002 |
| JP | 2002-326376 | | 11/2002 |
| JP | 2003-039754 | | 2/2003 |

(Continued)

OTHER PUBLICATIONS

European search report issued Aug. 6, 2007 in corresponding European Patent Application No. 06003386.7.

*Primary Examiner*—Manish S. Shah
*Assistant Examiner*—Laura E Martin
(74) *Attorney, Agent, or Firm*—Edwards Angell Palmer & Dodge LLP; John J. Penny, Jr.

(57) ABSTRACT

A liquid ejection apparatus includes: a recording head 210 having a nozzle plate including openings, for ejecting liquid to a recording article 300; an absorbing member 420 disposed further than the recording medium 300 on the orbit of the liquid ejected from the nozzle plate 260, for absorbing the liquid which has not applied on the recording medium 300; an waste liquid absorbing member 600 having capillarity higher than that of the absorbing member 420 and being in contact with the absorbing member 420 on the connecting surface which is different from the absorbing surface, for sucking on the liquid which has been absorbed in the absorbing member 420; and a potential difference generating means 700 for generating a potential difference between the absorbing surface and the connecting surface of the absorbing member 420 and attracting the solute of the liquid from the absorbing surface to the connecting surface through electrophoresis. Thereby a nonvolatile solute is prevented from accumulating around the surface of the absorbing member.

12 Claims, 11 Drawing Sheets

FOREIGN PATENT DOCUMENTS

| | | |
|---|---|---|
| JP | 2003-072109 | 3/2003 |
| JP | 2003-211706 | 7/2003 |
| JP | 2004-009700 | 1/2004 |
| JP | 2004-106375 | 4/2004 |
| JP | 2004-142125 | 5/2004 |
| JP | 2004-155107 | 6/2004 |
| JP | 2004-155182 | 6/2004 |
| JP | 2004-202867 | 7/2004 |
| JP | 2004-209980 | 7/2004 |
| JP | 2004-216887 | 8/2004 |
| JP | 2004-230806 | 8/2004 |
| JP | 2004-262138 | 9/2004 |
| JP | 2004-314319 | 11/2004 |

* cited by examiner

LIQUID EJECTING APPARATUS

CROSS REFERENCE TO RELATED APPLICATION

The present application claims priority from Japanese Patent Applications Nos. JP 2005-044239 filed on Feb. 21, 2005, JP 2005-046269 filed on Feb. 22, 2005, JP 2006-009143 filed on Jan. 17, 2006 and JP 2006-009144 filed on Jan. 17, 2006, the contents of which are incorporated herein by reference.

BACKGROUND OF THE INVENTION

1. Field of the Invention

The present invention relates to a liquid ejection apparatus and, more specifically, to a liquid ejection apparatus for applying the liquid which ejects from nozzle openings of a nozzle plate mounted on a liquid ejection head.

2. Related Art

Conventionally, when a liquid is applied all over the margin of a recording medium such as papers, the liquid is ejected over the region larger than the size of the recording medium because the recording medium and the liquid ejection head may be displaced. Therefore, the liquid is also ejected to the region around both side edges and the top and bottom edges of the recording medium where the recording medium is not disposed. If the liquid which has not been applied to the recording medium is left, the liquid ejection apparatus itself, an undesired region of the recording medium and the hands of the user may be smeared.

Additionally, each liquid droplet ejecting from the liquid ejection apparatus is extremely small in volume up to several pl or pico-litter in order to improve the resolution of recording. Since the mass of such micro droplets is extremely small, the kinetic energy is rapidly lost due to the viscosity resistance of atmosphere as soon as those eject out in the air. For example, when the droplet of which amount is less than 8 pl travels in air by around 3 mm, the velocity becomes approximately zero. Meanwhile, the distance obtained by adding the interval between the recording medium and the absorbing member, and the gap between the nozzle plate and the recording medium is around 3-5 mm. Therefore, a part of the droplets which has not been applied on the recording medium loses the kinetic energy before arriving at the absorbing material. As for the droplets without the kinetic energy, the falling motion due to the acceleration of gravity and the viscosity resistance of atmosphere are approximately proportional, so that it takes a long time to completely fall the droplets.

Here, if the ejection velocity is increased in order to extend the travel distance of droplets, the viscosity resistance in atmosphere which acts on the droplet is further increased, so that the travel distance is shortened despite the intention. Additionally, if the ejection velocity is increased, the remarkably micro droplets referred to as a satellite ink, which are generated when the droplets are released from the nozzle plate is easily generated, undesirably.

Further, an operation referred to as a flushing is periodically performed in the liquid ejection apparatus. The flushing is an operation that the liquid ejection head without any recording medium is operated and the liquid is ejected. Thereby the liquid with the increased viscosity in the nozzle which is not frequently used is removed. However, the liquid ejected in the flushing is consumed only for the flushing and does not contribute to record the recording medium. Accordingly, small or fine liquid droplets eject in order to reduce the consumption of the liquid. Additionally, since the time required for the flushing causes the throughput of a recording operation to decrease, the liquid ejects from all the nozzles within a short time when the flushing is performed. In such flushing operation, the large amount of satellite ink is generated.

Most satellite ink generated under the above described various conditions floats around the region in which the liquid ejection head is moved and becomes aerosols. A part of the aerosols floats up to the outside of the liquid ejection apparatus and deposits around the liquid ejection apparatus. Then, most of the aerosols deposit on each section in the liquid ejection apparatus. Here, when the aerosols deposit on a convey path of the recording medium, such as a platen, the recording medium which is subsequently conveyed is polluted. Additionally, when the aerosols are deposited on an electric circuit, a linear scale or various optical sensors in the liquid ejection apparatus, it may cause the malfunction of the apparatus in itself. Further, when the user touches the sections on which the aerosols are deposited, the hands of the user are polluted. Thus, a technology for collecting the liquid which has not been applied on the recording medium has been proposed as disclosed, for example, in Japanese Patent Application Publication No. 11-320891.

Here, a mechanism is proposed, for guiding the liquid which travels to and arrives at a platen without applying on the recording medium into an waste liquid container different from the platen in a liquid ejection apparatus. In the liquid ejection apparatus, a through-hole is provided in the platen, and the liquid in the platen is guided into the individual waste liquid container via the through-hole. Therefore, it is prevented that the large amount of liquid remains in the platen and that any airborne droplet or mist is generated due to bumping the droplets against each other.

However, since the amount of liquid applied on the platen is not constant, it unexpectedly takes time to discharge the liquid to the outside of the platen, so that the liquid may sometimes remain oh the platen. In this case, it is impossible to prevent mists from generating. Additionally, if the discharge of liquid on the platen is delayed, the medium of liquid is evaporated and a nonvolatile component remains on the platen. When the nonvolatile component is accumulated on the platen, the recording medium which is in contact with the platen is polluted, and the irregularity of the surface of the fluid channel is generated on, the platen. Therefore, the flow of the waste liquid may be easily stopped.

To solve the above-described problems, a liquid ejection apparatus including an absorbing means is proposed in Japanese Patent Application Publication No. 2004-202867. The liquid ejection apparatus includes the absorbing means made of a porous material on the platen, for receiving the liquid which has not been applied on a recording medium and absorbing the same. The absorbing material has suction power in itself due to capillarity, so that the received liquid is held therein without scattering outside.

Additionally, another liquid ejection apparatus has been proposed in Japanese Patent Application Publication No. 2004-202867. In the liquid ejection apparatus, a metal member which will be an electrode is disposed on the surface of the, absorbing means, and an electric field is formed between a metal nozzle plate for ejecting liquid and the electrode. Since droplets ejecting from the nozzle plate are charged with the pole same as that of the nozzle plate, the droplets travel toward the electrode without decreasing the velocity due to coulomb force acting between the electric field and itself, and then are adsorbed on the electrode. The droplets adsorbed on the electrode are finally absorbed in the absorbing member.

As described above, the absorbing member made of the porous material has been used in the liquid ejection apparatus in order to absorb the liquid which arrives at the platen without applying on the recording medium. Here, since the absorbing member using the porous material has a function for holding liquid due to the capillarity in itself, a certain amount of liquid is continually held therein. However, the volatile component of the held liquid is evaporated around the surface of the absorbing member, so that the nonvolatile component is intensively accumulated adjacent to the surface of the absorbing member. Therefore, the absorbing member is clogged so that the desired function of the absorbing member, which receives the liquid without generating any mist may be lost. Additionally, most nonvolatile component accumulated on the surface of the absorbing member includes pigment composition. Thereby the recording medium subsequently provided may be polluted.

SUMMARY OF THE INVENTION

To solve the above-described problem, a first embodiment of the present invention provides a liquid injecting apparatus. The liquid injecting apparatus includes: a liquid ejection head including a nozzle plate having openings, for discharging liquid into a recording medium; an absorbing member disposed further than the recording medium on the orbit of the liquid discharged from the nozzle plate and having an absorbing surface for absorbing the liquid which has not applied on the recording medium; an waste liquid absorbing member having a capillarity higher than that of the absorbing member and being in contact with the absorbing member on a connecting surface different from the absorbing surface, for sucking in the liquid absorbed in the absorbing member; and a potential difference generating means for generating a potential difference between the absorbing surface and the connecting surface of the absorbing member and for attracting the solute of the liquid from the absorbing surface to the connecting surface through electrophoresis. Thereby the solute such as dye and pigment which is dispersed with a charge in the liquid can be actively moved toward the portion in contact with the waste liquid absorbing member in the interior of the absorbing member. Accordingly, the solute is not intensively accumulated around the surface of the absorbing member so that the performance of the absorbing member is not deteriorated.

In the liquid ejection apparatus according to another embodiment of the present invention, one end of the potential difference generation means connects to a connecting surface side electrode abutted against the absorbing member around the connecting surface, for positioning the connecting surface. Thereby the positioning and the good electrical connection of the absorbing member can be achieved with a simple configuration.

In the liquid ejection apparatus according to another embodiment of the present invention, the other end of the potential difference generation means connects to an absorbing surface side electrode disposed adjacent to the absorbing surface. Thereby the potential of the surface of the absorbing member is clearly defined, so that the solute can be most effectively sucked.

In the liquid ejection apparatus according to another embodiment of the present invention, the other end of the potential difference generation means connects to the absorbing surface side electrode disposed adjacent to the rear surface of the absorbing surface. Thereby the electrode of the other end is not wet with the charged liquid, so that the electric field formed by the electrode is prevented from deteriorating.

In the liquid ejection apparatus according to another embodiment of the present invention, the other end of the potential difference generating means connects to the absorbing surface side electrode embedded into the absorbing means. Thereby the contact between the electrode of the other end and the absorbing member is appropriately maintained. Further, the relative positioning can be secured each other, so that a stable performance can be achieved.

Additionally, according to another embodiment of the present invention, the liquid ejection apparatus has an external potential difference generating means for generating a potential difference between the nozzle plate and the absorbing surface of the absorbing member outside the absorbing member and for electrically attracting the liquid ejecting from the nozzle plate to the absorbing surface. Thereby an electric field generated between the nozzle plate and the absorbing member outside the absorbing member causes aerosols to be attracted to the absorbing member. The aerosols attracted to the absorbing member is absorbed in the absorbing member and then, the solute contained in the liquid is attracted to the waste liquid absorbing member due to the electric field generated within the absorbing member. Accordingly, the aerosols floating inside is reduced and it is prevented that the nonvolatile solute is intensively accumulated around the surface of the absorbing member.

Additionally, in the liquid ejection apparatus according to another embodiment of the present invention, the nozzle plate has conductivity, and one end of the external potential difference generating member is connected to the nozzle plate. Thereby an electric field including one end of the nozzle plate is formed, so that aerosols can be effectively collected.

Additionally, in the liquid ejection apparatus according to another embodiment of the present invention, the other end of the external potential difference generating means connects to a connecting surface side electrode which is abutted against the absorbing member around the connecting surface, for positioning the connecting surface. Thereby the absorbing member can be surely positioned without increasing the number of components. Further, the liquid can be smoothly absorbed from the absorbing member to the waste liquid absorbing member.

Further, in the liquid ejection apparatus according to another embodiment of the present invention, the other end of the external potential difference generating means is connected to the absorbing surface side electrode disposed adjacent to the absorbing surface. Thereby an electric field is generated between the nozzle plate and the absorbing surface, so that aerosols can be effectively collected.

Furthermore, in the liquid ejection apparatus according to another embodiment of the present invention, the other end of the external potential difference generating means is connected to the absorbing surface side electrode disposed adjacent to the rear surface of the absorbing surface. Thereby any liquid is not applied directly on the absorbing surface side electrode, so that the desired performance can be maintained for a long time.

Furthermore, in the liquid ejection apparatus according to another embodiment of the present invention, the potential difference generating means and the external potential difference generating means include individual potential difference generating circuits, respectively. Thereby the potential of the surface of the absorbing member is appropriately set, so that a desired electric field can be easily generated.

Furthermore, in the liquid ejection apparatus according to another embodiment of the present inventions, the potential difference generating means and the external potential difference generating means include a single potential difference generating circuit, and a switching circuit for selectively switching a first connection state in which the output of the potential difference generating circuit is coupled to the absorbing surface and the connecting surface of the absorbing member, and a second connection state in which the output of the potential difference generating circuit is coupled to the nozzle plate and the absorbing member. Thereby one potential difference generating means is switchably used in the liquid ejection apparatus, so that the number of components can be reduced, and the cost can be reduced and the apparatus can be made compact.

Here, the technical term "solute" described in the specification is all compositions except for the medium which is mainly contained in the liquid used for the liquid ejection apparatus. Additionally, the solute includes liquid substance dissolved into the medium and also the substance dispersed in the medium in solid condition.

Here, all necessary features of the present invention are not listed in the summary of the invention. The sub-combinations of the features may become the invention.

DETAILED DESCRIPTION OF THE INVENTION

Hereinafter, the present invention will now be described through referred embodiments. The embodiments do not limit the invention according to claims and all combinations of the features described in the embodiments are not necessarily essential to means for solving the problems of the invention.

Figure 1:
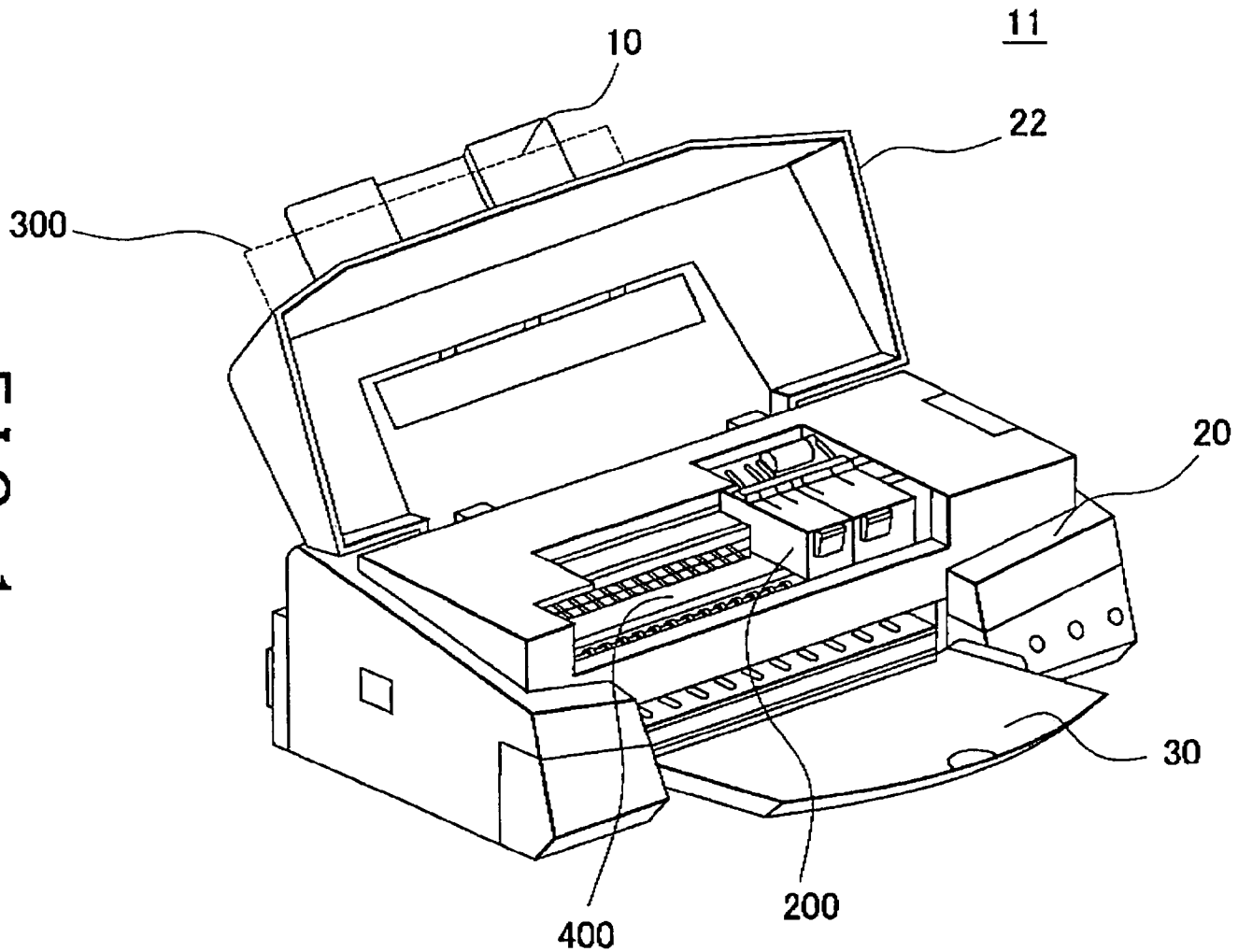
FIG. 1 is a perspective view showing the whole of an inkjet recording apparatus 11 which is one type of the liquid ejection apparatus.

FIG. 1 is a perspective view showing the whole of an inkjet recording apparatus 11 which is one example of the liquid ejection apparatus. As shown in FIG. 1, The inkjet recording apparatus 11 includes a lower case 20 serving as a main component of the apparatus, a upper case 22 forming a housing in cooperate with the lower case 20, a paper support 10 attached to the backside of the lower case, 20 and a discharge tray 30 formed in front of the lower case 20. Here, as shown in FIG. 1, when the upper case 22 serving as a cover opens, a platen 400 horizontally disposed in the lower case 20 and a carriage 200 disposed above the platen 400 appear.

In the above-described inkjet recording apparatus 11, recording mediums 300 loaded in the paper support 10 are fed onto the platen 400 one by one and then, those are fed to the discharge try 30 by means of a discharge unit (not shown in the figure). The carriage 200 reciprocates in the direction perpendicular to the conveying direction of the recording mediums 300 above the platen 400. Thus, the conveying of the recording mediums 300 and the reciprocation of the carriage 200 are performed in turn, so that all over the top surface of the recording medium 300 can be scanned by the carriage 200. Therefore, an image can be recorded or printed on any region on the recording medium 300.

Figure 2:
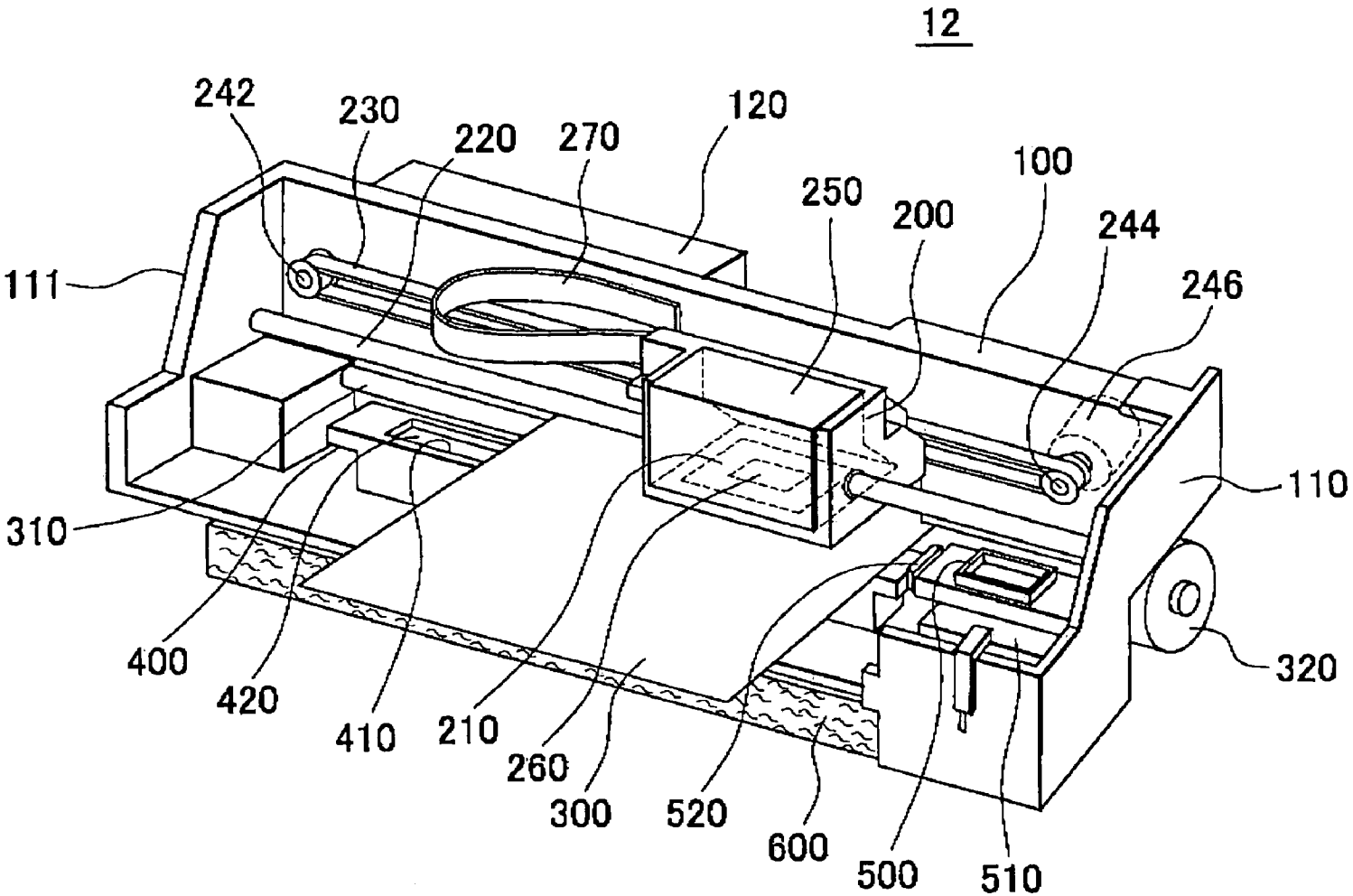
FIG. 2 is a perspective view showing an internal mechanism 12 of the inkjet recording apparatus 11.

FIG. 2 is a perspective view showing an internal mechanism 12 of the inkjet recording apparatus 11. As shown in FIG. 2, the internal mechanism 12 is enclosed by a flame 100, a pair of side surface portions 110 and 111. Here, the internal mechanism 12 is mainly formed within the area configured by the flame 100 approximately vertically disposed, and a pair of the side surface portion 100 and the side surface portion 111 extending forward from the both sides of the flame 100 in parallel each other.

The carriage 200 is held by a guide shaft 220 which penetrates through the carriage 200 in the internal mechanism 12. Both ends of the guide shaft 220 are supported by the side surface 110 and the side surface 111, and the guide surface 220 is disposed in parallel with the flame 100. Accordingly, the carriage 200 can be horizontally moved along the guide shaft 220.

In the back of the carriage 200, a pair of pulley 242 and pulley 244, and a timing belt put around the pulley 242 and the pulley 244 are disposed in front of the flame 100. The pulley 244 is rotationally driven by a carriage motor 246. The timing belt 230 is coupled to the backside of the carriage 200. Therefore, the carriage 200 can be reciprocated according to the operation of the carriage motor 246.

An ink cartridge 250 is loaded into the carriage 200. A recording head 210 is provided on the bottom surface of the carriage 200. The recording head 210 includes a metal nozzle plate 260 having openings for ejecting ink droplets. Accordingly, the ink droplets eject down from the carriage 200.

The carriage 200 is coupled to an electronic circuit 120 behind the flame 100 through a tape-like multicore cable 270. The multicore cable 270 flexibly bends according to the movement of the carriage 200 so as not to avoid the reciprocation of the carriage 200.

The platen 400 is disposed below the region through which the carriage 200 passes. The platen 400 supports from below the recording mediums 300 which pass through under the carriage 200 and holds the distance between the nozzle plate 260 and the recording medium 300 constant.

A concave portion 410 is formed on the top surface of the platen 400. An absorbing member 420 is accommodated in the concave portion 410. The absorbing member 420 receives the ink ejecting from the recording head 210 to a region in which there is no recording medium 300

Here, as the operating time of the ink jet recording apparatus 11 passes, ink is gradually deposited on the absorbing member 420. If the recording medium 300 come into contact with the absorbing member 420 on which the ink is applied, the recording medium 300 is polluted with the ink. In order to prevent such contact, a protruding portion is formed on the top surface of the platen 400, and then the recording medium 300 is lifted from below and held by the protruding portion. Therefore, a gap of about 3-5 mm is formed between the nozzle plate 260 and the absorbing member 420.

The absorptive capacity of the absorbing member 420 included the platen 400 is limited because its material is selected with the emphasis on the absorption speed on the surface. Here, a larger waste liquid absorbing member 600 is disposed under the platen 400 and in communication with the absorbing member 420. As for the waste liquid absorbing member 600, its absorptive capacity is important, and further a highly-absorbent material by capillarity is selected. Therefore, the waste liquid absorbing member 600 can absorb a large amount of ink from the absorbing member 420.

Meanwhile, a conveying roller 310 is disposed in the backside of the platen 400. The conveying roller 310 is driven by a conveying motor 320 disposed in the backside of the flame 100. The conveying roller 310 cooperates with a compliance roller (not shown in the figure) to feed the recording mediums 300 onto the platen 400. As described above, the carriage can reciprocate in the direction perpendicular to the direction to which the recording mediums 300 are conveyed. Therefore, the conveying of the recording mediums 300 and the reciprocation of the carriage 200 are performed in turn while the recording head 210 which is the bottom surface of the carriage 200 is intermittently operated, so that the ink can be ejected to any region on the recording medium and applied thereon.

In the internal mechanism 12, a cap member 500 is disposed in the side of the side surface 110 relative to the platen 400. The cap member 500 can move up and down. Then, the cap member 500 rises to seal the surface of the nozzle plate 260 when the carriage 200 stops at a home position near the side surface 110. The inside of the cap member 500 is coupled to a pump unit 510. The pump unit 510 can suck in the ink applied on the surface of the nozzle plate 260. The ink sucked in the pump unit 510 is absorbed in the waste liquid absorbing member. 600 through a pipe (not shown in the figure).

Additionally, a wiping means 520 is disposed between the platen 400 and the cap member 500. The wiping member 520 wipes the bottom surface of the nozzle plate 260 to clean the same when the carriage 200 released from the cap member 500 is passed thereover.

Figure 3:
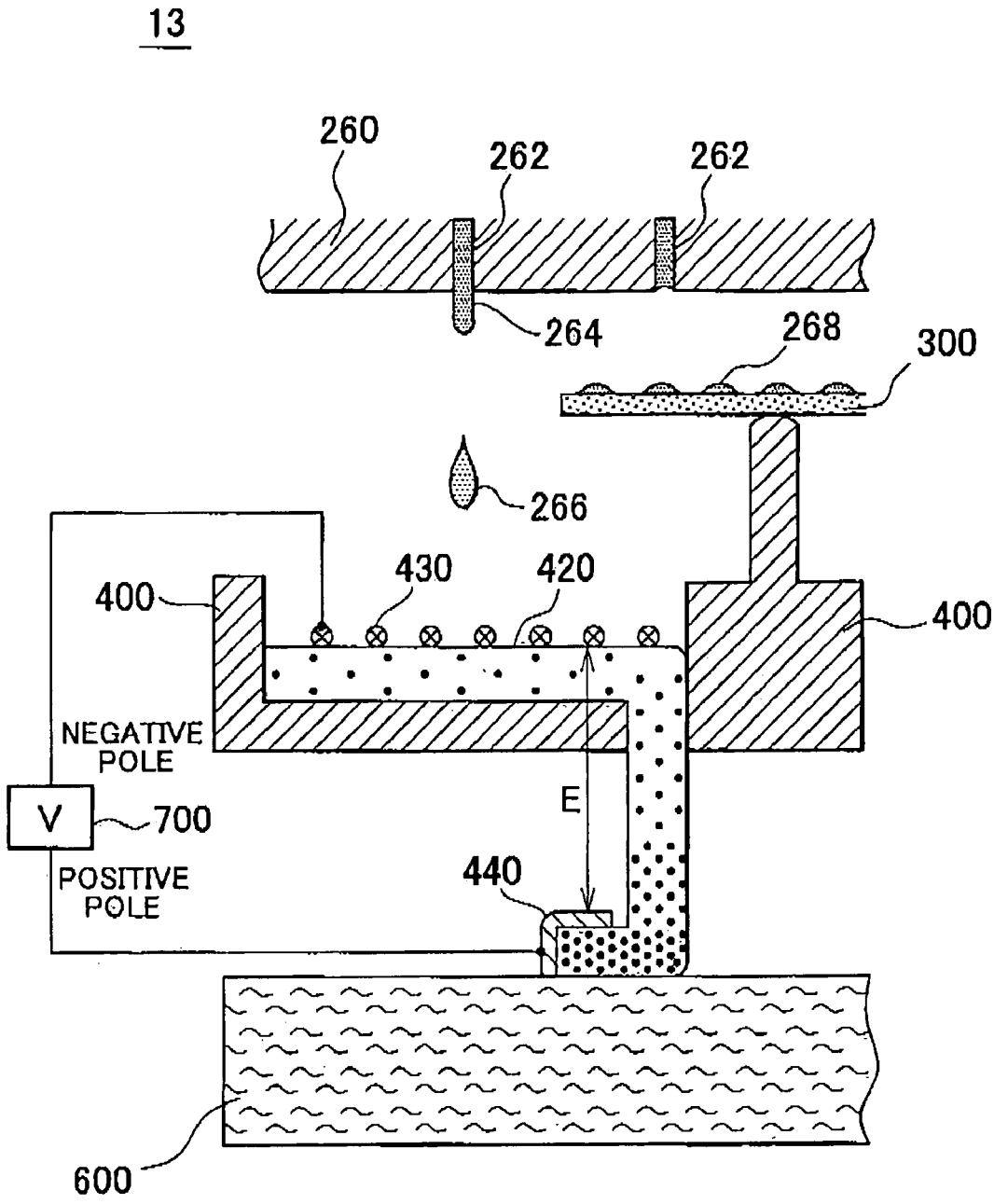
FIG. 3 is a schematic view showing a collecting mechanism 13 which can be implemented in the inkjet recording apparatus 11.

FIG. 3 is a drawing for explaining an embodiment and the operation of a collecting mechanism 13 for forming an electric field within the absorbing member 420 in the inkjet recording apparatus 11 including the above-described internal mechanism 12. As shown in FIG. 3, the absorbing member 420 is accommodated within the platen 400 for supporting the recording mediums 300 below the nozzle plate 260 having openings 262 for ejecting ink. The top surface of the absorbing member 420 is formed as an absorbing surface facing the nozzle plate 260. Additionally, a part of the absorbing member 420 is inserted into a hole formed in the bottom of the platen 400 and is extended downward. The region around the bottom end of the absorbing member 420 is formed as a connecting surface in contact with the top surface of the waste absorbing member 600.

An absorbing surface side electrode 430 is disposed in the top surface of the absorbing member 420. A connecting surface side electrode 440 is disposed in the bottom end of the absorbing member 420. Each of the absorbing surface side electrode 430 and the connecting surface side electrode 440 is disposed in contact with the absorbing member 420, respectively. Here, the connecting surface side electrode 440 connects to one end of an potential difference generating means 700 to contribute to apply the potential difference, holds the bottom end of the absorbing member 420 and sets the bottom end to the position at which the bottom end abuts against the waste liquid absorbing member 600. Meanwhile, the other end of the potential difference generating means 700 is electrically coupled to the absorbing surface side electrode 430. Therefore, a potential difference V depending on the output of the potential difference generating means 700 is formed between the absorbing surface side electrode 430 and the connecting surface side electrode 440. The potential difference V causes to form an electric field E between the absorbing surface of the absorbing member 420 facing the nozzle plate 260 and the connecting surface in contact with the waste liquid absorbing member 600.

In the inkjet recording apparatus 100 including the collecting mechanism 13 formed as described-above, droplets 268 ejected from the nozzle plate 260 are applied on the recording medium 300 when any recording medium 300 is disposed directly under the opening 262 of the nozzle plate 260. Here, when it intends to apply ink on the rim of the recording medium 300 entirely, the both sides, the top end and the bottom end of the recording medium might not be disposed directly under the openings 262. In this case, an ink column 264 ejected from the opening 262 becomes a droplet 266. Then, the droplet 266 is directly received and absorbed in the absorbing member 420.

The solute in the liquid is ionized and has a charge specified to its composition. Here, the substance having the charge in the liquid moves the pole opposite to that of the own charge through electrophoresis by applying an electric field to the liquid. Therefore, when the electric field E is formed by the absorbing surface side electrode 430 and the connecting surface side electrode 440, it is selected such that the pole of the charge of the solute in the ink is opposite to that of the connecting surface side electrode 440, so that the solute moves toward the connecting surface side electrode 440. Thus, the polarity of the potential difference V applied by the potential difference generating means 700 is appropriately selected according to the composition of the solute of the ink. Therefore, the solute in the ink can be moved to the connecting surface side electrode 440 through electrophoresis as indicated by the distribution of black dots in the absorbing member 420 shown in FIG. 3.

The effective electrophoresis in the absorbing member 420 is expressed under the condition that the sufficient amount of ink is absorbed in the absorbing member 420, and the absorbing surface side electrode 430 and the connecting surface side electrode 440 are coupled by the solvent of the ink. Meanwhile, at the beginning of the operation of the inkjet recording apparatus 11, only a little amount of ink is contained in the absorbing member 420. Therefore, any effective electrophoresis may be generated. Then, when the recording operation is continued and the absorbing member 420 contains a certain amount of ink, the solvent continuously exists in the absorbing member within about several tens of seconds. Therefore, the solute is moved into the absorbing member 420 through electrophoresis, so that the solute is prevented from intensively accumulating on the surface of the absorbing member 420. Additionally, when the amount of ink contained in the absorbing member 420 further increases, and the solvent extends to the connecting surface side electrode 440, the solute moved utilizing the effect of electrophoresis is sequentially absorbed in the waste liquid absorbing member 600. Therefore, any solute does not remain in the absorbing member 420, so that it is prevented that the performance of the absorbing member 420 is reduced due to the accumulation of the solute.

Preferably, the above-described solute collection is operated immediately after the recording operation of the inkjet recording apparatus 11 is terminated, so that good effect is achieved. Therefore, it is preferred that a timer (not shown in the figure) for controlling the potential difference generating means 700 of the collecting mechanism 13 is provided, and the collecting mechanism 13 is continuously operated during a certain period around from several minutes to one hour after the recording operation of the inkjet recording apparatus 11 is terminated. Thereby the solute of the ink is removed from the absorbing member 420 immediately after the recording operation of the inkjet recording apparatus 11 is terminated, so that any solute component is not accumulated in the absorbing member 420 even if the recording operation is not performed for a long time after terminating the previous operation.

Thus, the solute is moved to the connecting surface side electrode 440, so that the solute adjacent to the surface of the absorbing member 420 is reduced therefore, the solute which is the nonvolatile component is not accumulated on the surface of the absorbing member 420 even if the volatile component in the ink is evaporated. Additionally, in the bottom end of the absorbing member 420, the solute is absorbed along with the medium by the waste liquid absorbing member 600 having the strong absorptive power. Therefore, the solute is, also not accumulated in the bottom end of the absorbing member 420. Here, pulps and compressed chemical fibers, or a material obtained by mixing polymer absorbent thereto can be preferably used as the waste liquid absorbing member 600.

Figure 4:
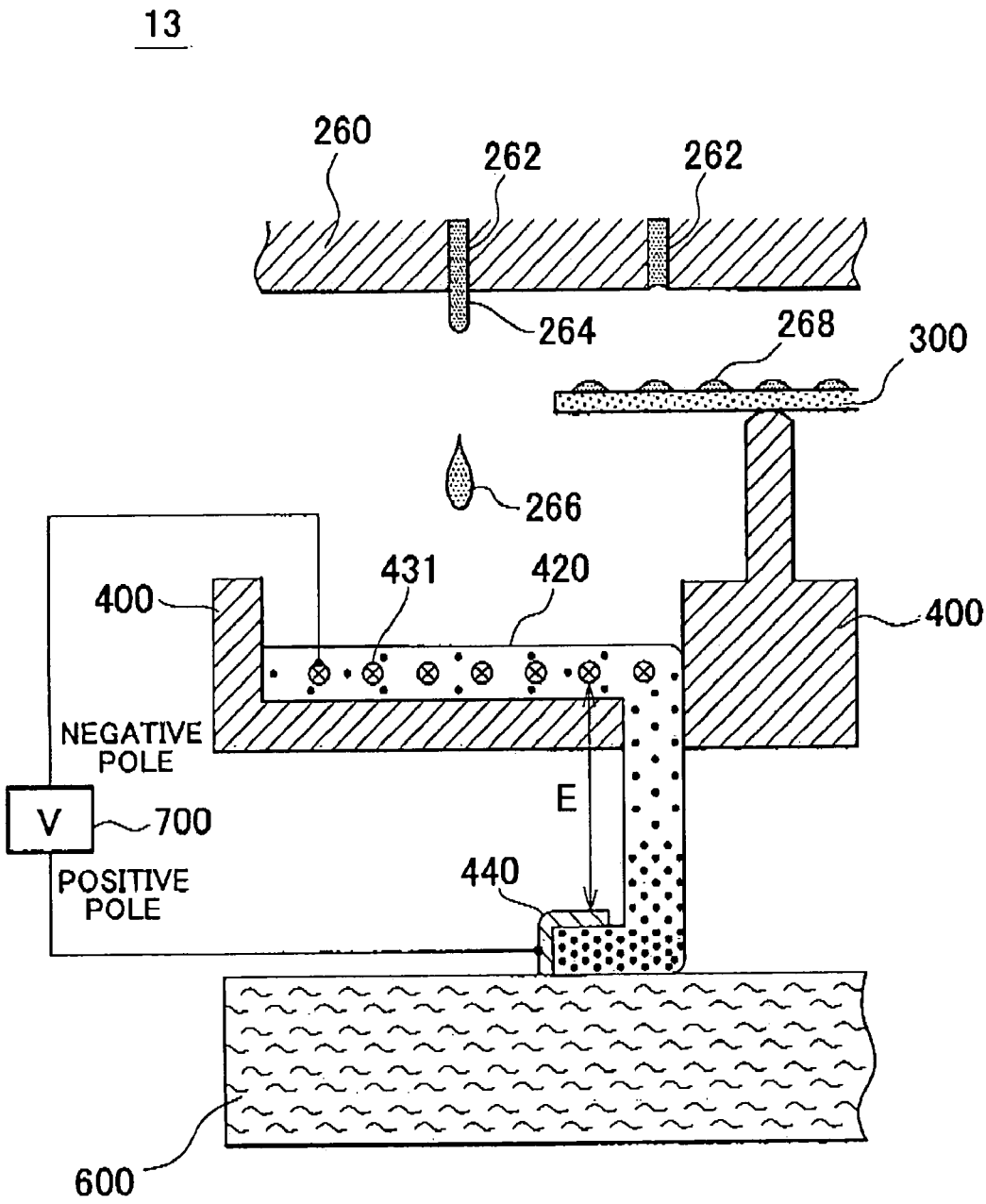
FIG. 4 is a schematic view showing another collecting mechanism 13 which can be implemented in the inkjet recording apparatus 11.

FIG. 4 is a drawing for explaining another embodiment and the operation of the collecting mechanism 13. In FIG. 4, components identical to each of the other drawings have been marked with the same reference numerals, and the repeating description is omitted. As shown in FIG. 4, one end of the potential difference generating means 700 connects to the connecting surface side electrode 440 in the collecting mechanism 13 as well as FIG. 3. Meanwhile, an absorbing surface side electrode 431 connecting to the other end of the potential difference generating means 700 is embedded in a concave portion 410 of the platen 400, that is, the absorbing surface side electrode 431 is embedded in the absorbing member 420 in itself. That is the feature of the configuration according to the present embodiment.

In the present embodiment, the other configuration is same as the embodiment with reference to FIG. 3. According to such configuration, the electric field E is generated between the approximately top surface and the bottom end of the absorbing member 420 due to the potential difference V outputted by the potential difference generating means 700. Therefore, the solute in the ink absorbed in the absorbing member 420 can be moved to the connecting surface side electrode 440, so that the solute adjacent to the absorbing member 420 can be reduced.

Figure 5:
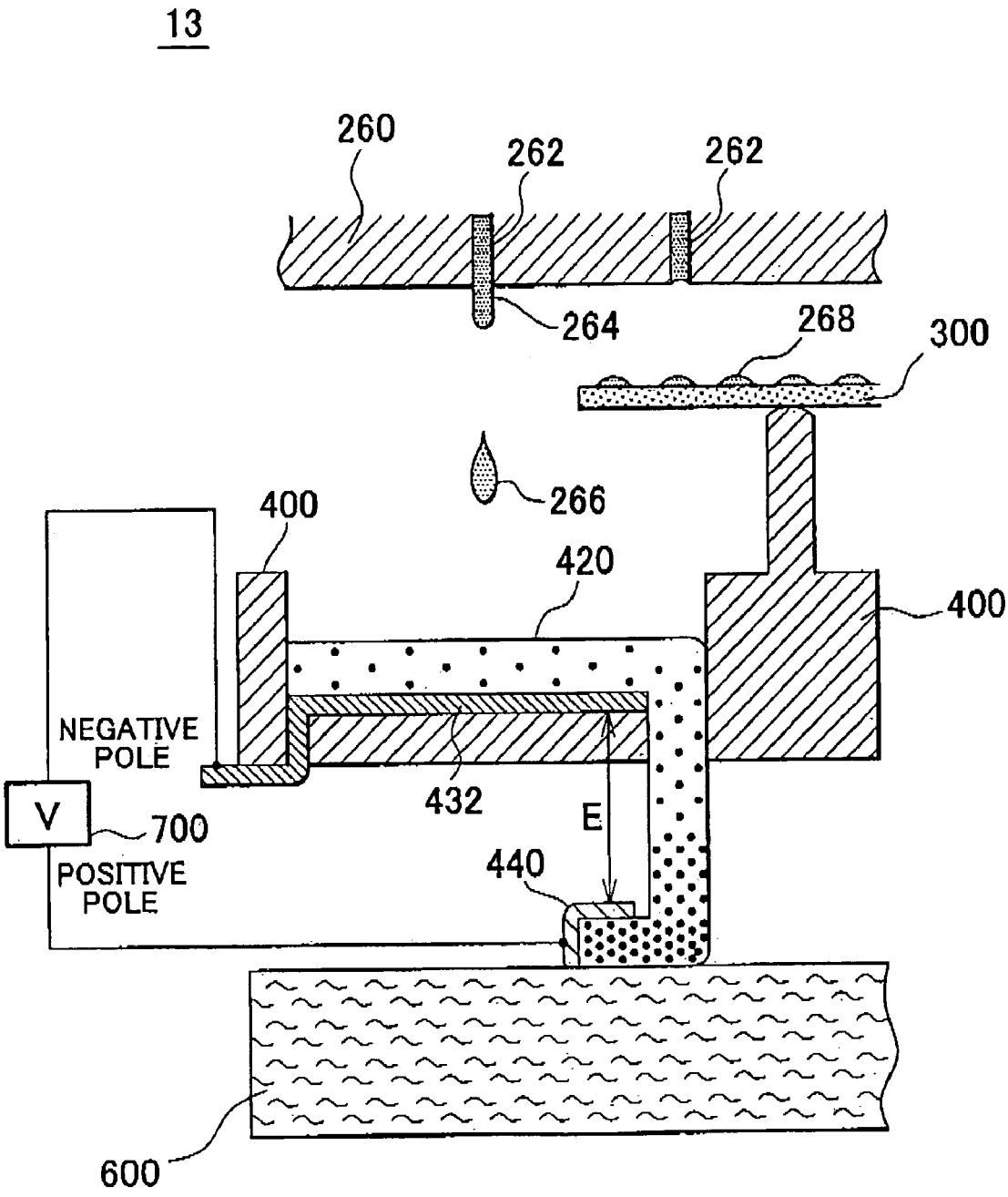
FIG. 5 is a schematic view showing another collecting mechanism 13 which can be implemented in the inkjet recording apparatus 11.

FIG. 5 is a drawing for explaining still another embodiment and the operation of the collecting mechanism 13. In FIG. 5, components identical to each of the other drawings have been marked with the same reference numerals, and the repeating description is omitted. As shown in FIG. 5, one end of the potential difference generating means 700 connects to the connecting surface side electrode 440 in the collecting mechanism 13 as well as FIG. 4. Meanwhile, an absorbing surface side electrode 432 connecting to the other end of the potential difference generating means 700 is formed by a conductor provided on the bottom of the concave portion 410 of the platen 400. That is to say, the absorbing surface side electrode 432 is disposed on the rear surface of the plane facing the nozzle plate 260 of the absorbing member 420.

Here, the absorbing surface side electrode 432 covers approximately all over the bottom of the concave portion of the platen 400, and the absorbing member 420 of which shape is the same as that of the absorbing surface side electrode 432 is accommodated thereon. Thus, the whole of the bottom surface of the absorbing member 420 is in contact with the absorbing surface side electrode 432, so that the absorbing member 420 and the absorbing surface side electrode 432 are electrically connected over a large area. Therefore, even if there is any section which is not electrically connected in the structure of the absorbing member 420, the potential of the whole absorbing member 420 is approximately same as that of the absorbing surface side electrode 432. Meanwhile, in a portion of the absorbing member 420, which extends downward from the bottom of platen 400, the effect of electric resistance is increased in proportion to the distance from the absorbing surface side electrode 432. Therefore, the electric field E based on the potential difference V is formed in the portion extending under the absorbing member 420.

As described-above, the unique electric field E is formed in the present embodiment. However, the potential difference is generated between the surface of the absorbing member 420 and the bottom end of the absorbing member 420, and the electric field E is formed therebetween as well as the former described embodiments. Therefore, the solute in the ink absorbed in the absorbing member 420 can be moved to the connecting surface side electrode 440, so that the solute adjacent to the absorbing member 420 can be reduced.

Here, in each embodiment described with reference to FIG. 3, FIG. 4 and FIG. 5, a metal having corrosion resistance against the ink used for the inkjet recording apparatus 11, such as aurum, stainless or nickel, or a material obtained by plating copper with those metals can be used as a material for each of the absorbing surface side electrode 430, 431, 432 and 440, for example. Additionally, a member formed by arranging linear materials or plate materials of about 0.1 mm-0.5 mm which are made of the above materials at intervals of 0.5 mm-4 mm and in parallel, or combining the same in a reticular pattern can be used as the member for each absorbing surface side electrode 430, 431, 432 and 440. Further, it is preferred that the member used as the absorbing side surface side electrodes 430 and 431 includes a pass region having the size enough to pass through the incoming ink to the bottom of the absorbing member 420. Furthermore, foam resin such as polyethylene and polyurethane can be used for the absorbing member 420, for example, but it is not limited to those materials.

Figure 6:
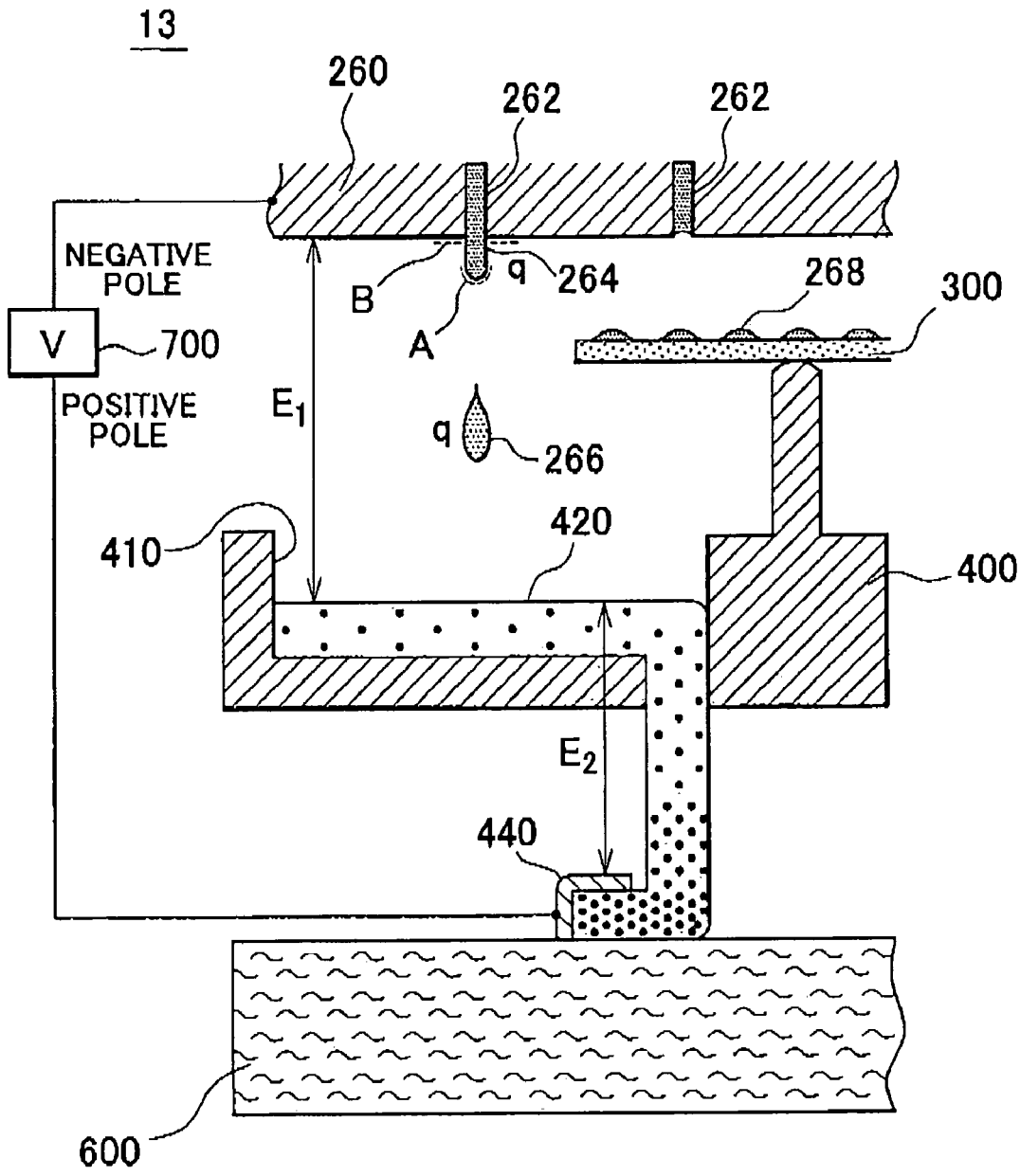
FIG. 6 is a schematic view showing another collecting mechanism 13 which can be implemented in the inkjet recording apparatus 11.

FIG. 6 is a schematic view showing the configuration and the function of the collecting mechanism 13 which can collect aerosols floating around the nozzle plate 260 and the solute in the absorbing member 420 in the inkjet recording apparatus 11. Here, components identical to each of the other drawings have been also marked with the same reference numerals, and the repeating description is omitted in FIG. 6.

As shown in FIG. 6, the absorbing member 420 is accommodated in the concave portion 410 in the platen 400 in the collecting mechanism 13. The top surface of the absorbing member 420 is an absorbing surface for receiving ink. Additionally, a part of the absorbing member 420 is inserted into a hole formed in the bottom of the platen 400 and extends downward, and a portion around the downward extending portion is in contact with the top surface of the waste liquid absorbing member 600 as a connecting surface.

Further, the connecting surface side electrode 440 is attached to the bottom end of the absorbing member 420. The connecting surface side electrode 440 connects to the other end of the potential difference generating means 700 to contribute to apply the potential difference, and has a physical function for holding the bottom end of the absorbing member 420 and positioning thereof.

Here, a metal having corrosion resistance against the ink used for the inkjet recording apparatus 11, such as aurum, stainless or nickel, or a material obtained by plating copper with those metals can be used for the material for the connecting surface side electrode 440, for example.

As for the material for the absorbing member 420, a conductive material having the surface resistance less than $10^8\Omega$, such as a material obtained by mixing resin such as polyethylene and polyurethane with the conductive material such as metal and carbon and foaming the mixture, and a material obtained by applying a conductive material such as metal and carbon on foam resin such as polyethylene and polyurethane, or plating the foam resin with the conductive material can be used. Additionally, a material obtained by impregnating foam resin such as polyethylene and polyurethane with electrolyte solution can be used as the absorbing member 420.

In the collecting mechanism 13 for collecting the satellite ink and solute as shown in FIG. 6, a plurality of openings 262 for ejecting ink are formed in the nozzle plate 260. Normally, the recording medium 300 supported from below by the platen 400 is placed immediately under the nozzle plate 260. Accordingly, the droplet 268 ejected from the nozzle plate 260 is applied on the recording medium 300.

Meanwhile, when it intends to apply ink all over the rim of the recording medium 300, the both sides, the top end and the bottom end of the recording medium 300 might not be disposed directly under a part of openings 262. In this case, the kinetic energy applied to the droplets 266 by ejecting from the openings 262 is rapidly lost due to the viscous resistance and the kinetic energy of a part of droplets 266 is entirely lost fat before arriving at the absorbing member 420. Additionally, since the mass of the droplets 266 is very small, the falling motion due to the gravitational acceleration is approximately equivalent to the viscous resistance due to the atmosphere, so that the fall velocity of the droplets 266 is significantly slowed down. Thus, aerosols generate and float below the nozzle plate 260.

Here, in the collecting mechanism 13 shown in FIG. 6, the electric field E1 is formed between the nozzle plate 260 and the absorbing member 420, and the electric field E2 is formed between the top surface of the absorbing member 240 which is an absorbing surface and the bottom end of the absorbing member 420 which is a connecting surface, respectively. That is to say, one end of the potential difference generating means 700 connects to the nozzle plate 260, and the other of that connects to the connecting surface side electrode 440, respectively, so that the potential difference V is generated therebetween. Additionally, a potential difference is generated between the connecting surface and the absorbing surface of the absorbing member 420 due to the voltage drop according to the direct current resistance value of the absorbing member 420. Therefore, an electric field E1 is generated between the nozzle plate 260 and the absorbing surface of the absorbing member 420 depending on the potential difference and the distance therebetween. Additionally, an electric field E2 is also generated between the absorbing surface and the connecting surface of the absorbing member 420 depending on the potential difference and the distance therebetween.

The ink ejected from the openings 262 becomes an ink column 264 which will drop from the nozzle plate 260 at the moment immediately before it becomes the droplet 266. At this time, it generates so-called lightning conductor effect between the tip A of the ink column 264 and a region B of the bottom surface of the nozzle plate 260 around the ink column 264. In other words, the lightning conductor effect is that the region B of the surface of the nozzle plate 260 which is enclosed by a cone of which vertex angle is 50 degree-60 degree, where the vertex is the tip A of the ink column 260 (shown as the bottom end in the figure), contributes to charge the droplet 266. Due to the lightning conductor effect, the droplet 266 charges with electricity more than that corresponding to the horizontal cross section of the ink column 264.

Next, the ink column 264 leaves the nozzle plate 260 and becomes the droplet 266. Then, the droplet 266 takes with a charge q accumulated due to the above-described lightning conductor effect. Therefore, the droplet 266 having the charge q obtains a kinetic energy by Coulomb force (qE1) from the electric field E1 and moves downward without decreasing the speed, and can arrive at the absorbing member 420.

Further, the electric field E2 is formed within the absorbing member 420. The solute in the liquid has the charge unique to each composition. The composition having the charge generates electrophoresis to move toward the pole opposite to that of the charge in the electric field. Therefore, if it is selected such that the polarity of the connecting surface side electrode 440 is opposite to that of the charge of the solute in the ink contained in the absorbing member 420, the solute can be attracted to the connecting surface side electrode 440. Thus, the solute in the ink can be moved to the connecting surface side electrode 440 shown as the black dots distribution in the absorbing member 420 in FIG. 6.

Here, the effective electrophoresis within the absorbing member 420 is expressed under the condition that the sufficient amount of ink is absorbed in the absorbing member 420 and each of the electrodes for forming the electric field E2 is coupled by the solvent of the ink. Meanwhile, at the beginning of operating the inkjet recording apparatus 11, only a little amount of ink is contained in the absorbing member 420. Therefore, sometimes any effective electrophoresis is not generated at the beginning of operating the inkjet recording apparatus 11. Then, the recording operation is continued, and the absorbing member 420 gradually contains a certain amount of ink, so that the solvent is continuously contained in the absorbing member 420. Therefore, the solute is moved into the absorbing member 420 through electrophoresis, so that it is prevented that the solute is intensively accumulated on the surface of the absorbing member 420. Additionally, the solute arrived at the waste liquid absorbing member 600 is sequentially absorbed from the absorbing member 420. Accordingly, any solute does not remain in the absorbing member 420, so that the performance of the absorbing member 420 is prevented from reducing due to the accumulation of the solute.

To move the solute toward the connecting surface side electrode 440 within the absorbing member 420 of which capacity is limited means that the solute adjacent to the absorbing surface of the absorbing member 420 is reduced. Accordingly, even if the volatile component is evaporated from the absorbing surface of the absorbing member 420, the solute which is the nonvolatile component of ink is not accumulated adjacent to the absorbing surface. Additionally, the solute is absorbed along with the medium in the connecting surface of the absorbing member 420 by the waste liquid absorbing member 600 having the strong absorptive power. Therefore, any solute is not accumulated on the bottom end of the absorbing member 420. Here, pulps, compressed chemical fibers or a material obtained by mixing polymer absorbent thereto can be preferably used as the material for the waste liquid absorbing member 600.

Figure 7:
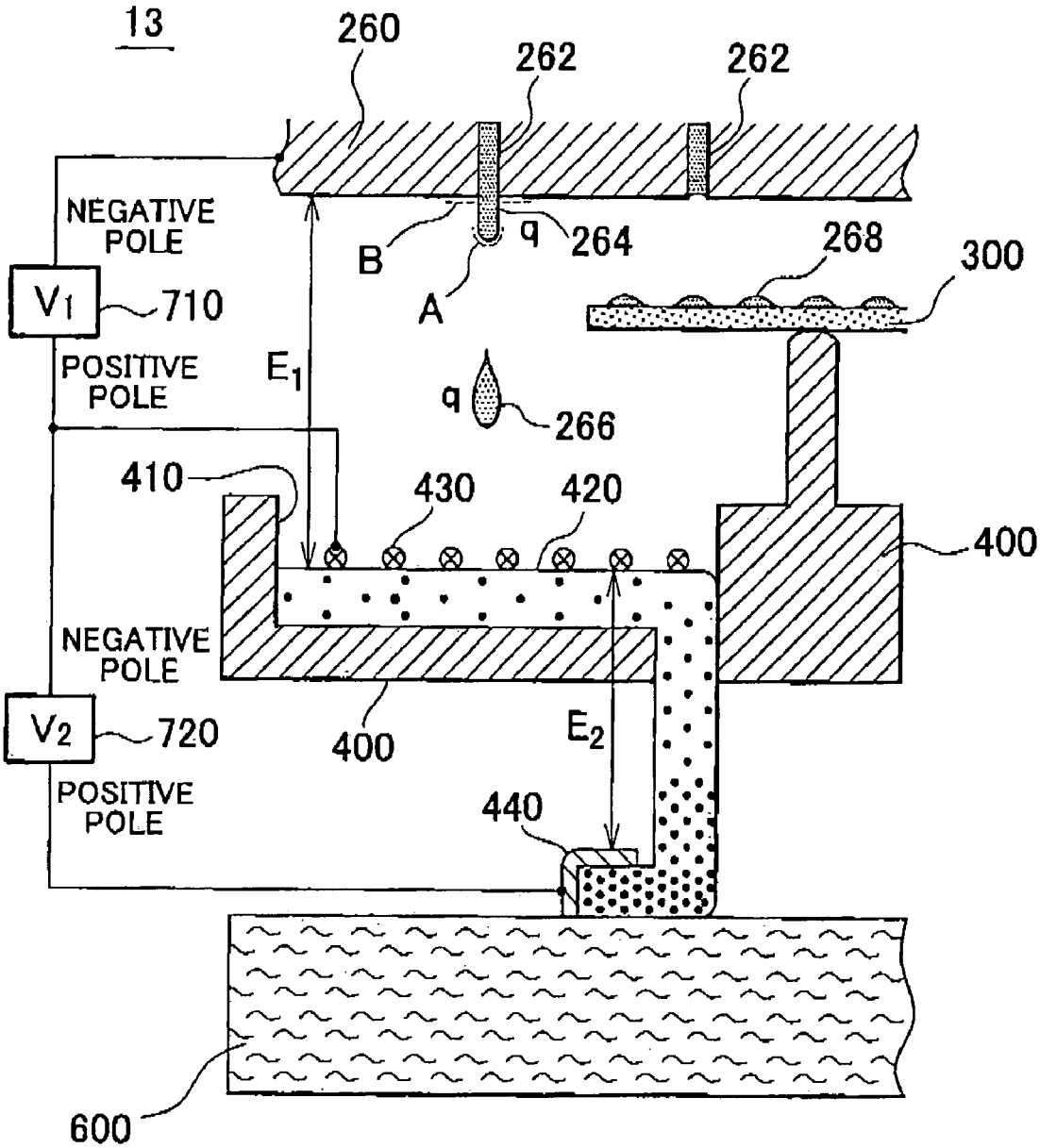
FIG. 7 is a schematic view showing another collecting mechanism 13 which can be implemented in the inkjet recording apparatus 11.

FIG. 7 is a schematic view showing another embodiment of the collecting mechanism 13 for collecting the satellite ink and solute. Here, components identical to that of FIG. 6 have been also marked with the same reference numerals, and the repeating description is omitted. As shown in FIG. 7, a meshed absorbing side electrode 430 is disposed on the top surface of the absorbing member 420. The unique feature of the present embodiment is that a pair of potential difference generating means is separately provided. Where, one of an external potential difference generating means 710 for generating the potential difference $V_1$ is provided between the nozzle plate 260 and the absorbing surface side electrode 430. The other of an inner potential difference generating means 720 for generating the potential difference $V_2$ is provided between the absorbing surface and the connecting surface of the absorbing member 420. Here, "inner" means that the inner potential difference generating means 720 is a potential difference generating means for forming the electric field $E_2$ inside of the absorbing member 420.

Due to the above-described configuration, the electric field $E_1$ between the nozzle plate 260 and the absorbing surface side electrode 430, and the electric field $E_2$ between the absorbing surface side electrode 430 and the connecting surface side electrode 440 can be appropriately set, respectively. Accordingly, aerosols can be efficiently absorbed in the absorbing member 420, and also the solute in the absorbing member 420 can be efficiently moved to the connecting surface, respectively.

Here, as for the material for the absorbing surface side electrode 430, a metal having corrosion resistance against the ink used for the inkjet recording apparatus 11, such as aurum, stainless or nickel, or a material obtained by plating copper with those metals can be used, for example. Additionally, a member formed by arranging linear materials or plate materials of about 0.1 mm-0.5 mm which are made of the above materials at intervals of 0.5 mm-4 mm and in parallel or combining the same in a reticular pattern can be used as the member for the absorbing surface side electrode 430. Further, it is preferred that the member used as the absorbing side surface side electrodes 430 and includes a pass region having the size enough to pass through the incoming ink to the bottom of the absorbing member 420. Furthermore, a foam resin such as polyethylene and polyurethane can be used for the material for the absorbing member 420, for example, but it is not limited to those materials.

Preferably, the solute collecting operation is performed immediately after finishing the recording operation, of the inkjet recording apparatus 11, so that good effect is achieved. Therefore, it is preferred that a timer (not shown in the figure) for controlling the inner potential difference generating means 720 connected to the collecting mechanism 13 is provided to continuously operate the collecting mechanism 13 for a certain period from several minutes to one hour after the recording operation of the inkjet recording apparatus 11 is finished. Thereby the solute of ink is removed from the absorbing member 420 immediately after the recording operation of the inkjet recording apparatus 11 is finished, so that any solute composition is not accumulated in the absorbing member 420 even if the recording operation is not performed for a long time after terminating the previous operation.

Figure 8:
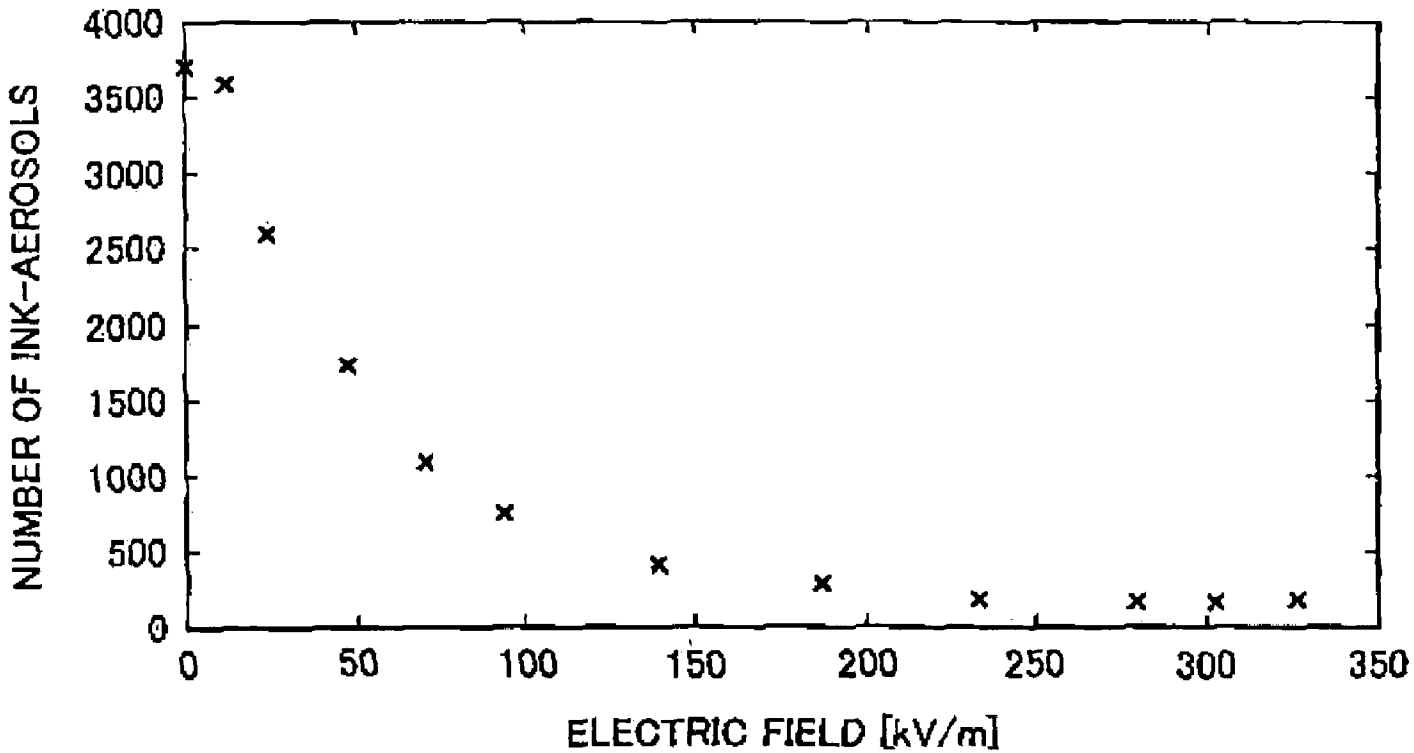
FIG. 8 is a graph showing the relationship between an applied electric field and the number of aerosols in an embodiment.

FIG. 8 is a graph showing the relationship between the applied electric field and the number of aerosols in the embodiment shown in FIG. 7. That is to say, while the outputs of the inner potential difference generating means 720 is kept at a constant state, electric fields with various intensity are generated between the nozzle plate 260 and the absorbing surface side electrode 430 and recorded the same. Then, the amount of the resultant aerosols is measured and plotted. When the measurement is performed, the average size of a droplet is determined as 7 pl, five sheets of recording mediums with A4 size are recorded for 7 minutes and 38 seconds after the beginning of printing. Additionally, the total number of aerosols which are counted for eight minutes after the beginning of the printing is divided by 8 and the resultant value is the number of aerosols per minute. As shown in FIG. 8, the number of aerosols is significantly decreased when the electric field is more than 25 Kv/m in comparison with-that there is no electric field. Therefore, it is understood that aerosols can be collected to a satisfactory extent.

Figure 9:
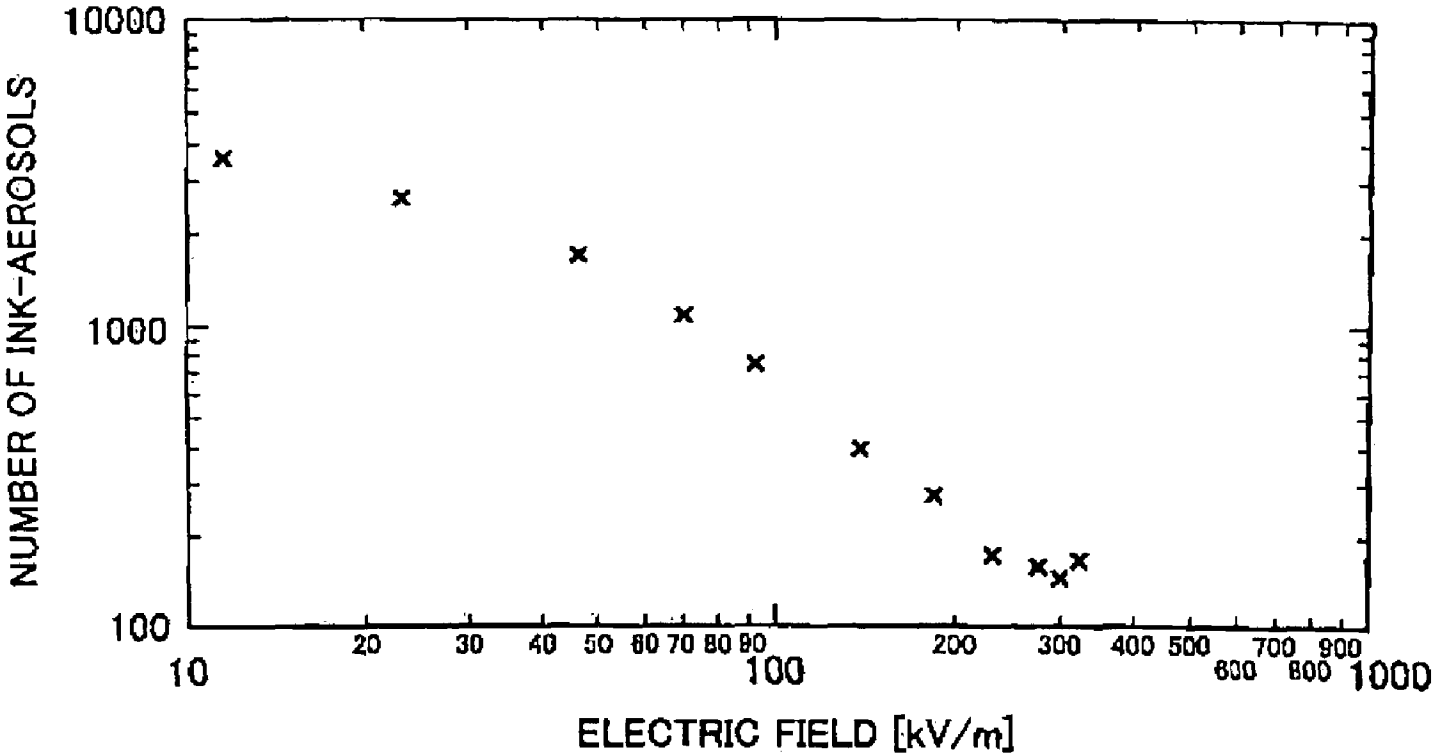
FIG. 9 is a logarithmic graph showing the number of aerosols in the graph shown in FIG. 8.

FIG. 9 is a logarithmic graph showing the relationship between the number of aerosols (vertical axis) and the applied electric field (abscissa axis) shown in FIG. 8. As shown in FIG. 9, when the applied electric field set at a high level, the number of aerosols is continuously decreased, and then, the rate of decreasing is gradually slowed down. Additionally, the rate of decreasing is uneven when the applied electric field is more than 250 KV/m. Thereby it is understood that the utilization ratio of the applied electric power is reduced.

Figure 10:
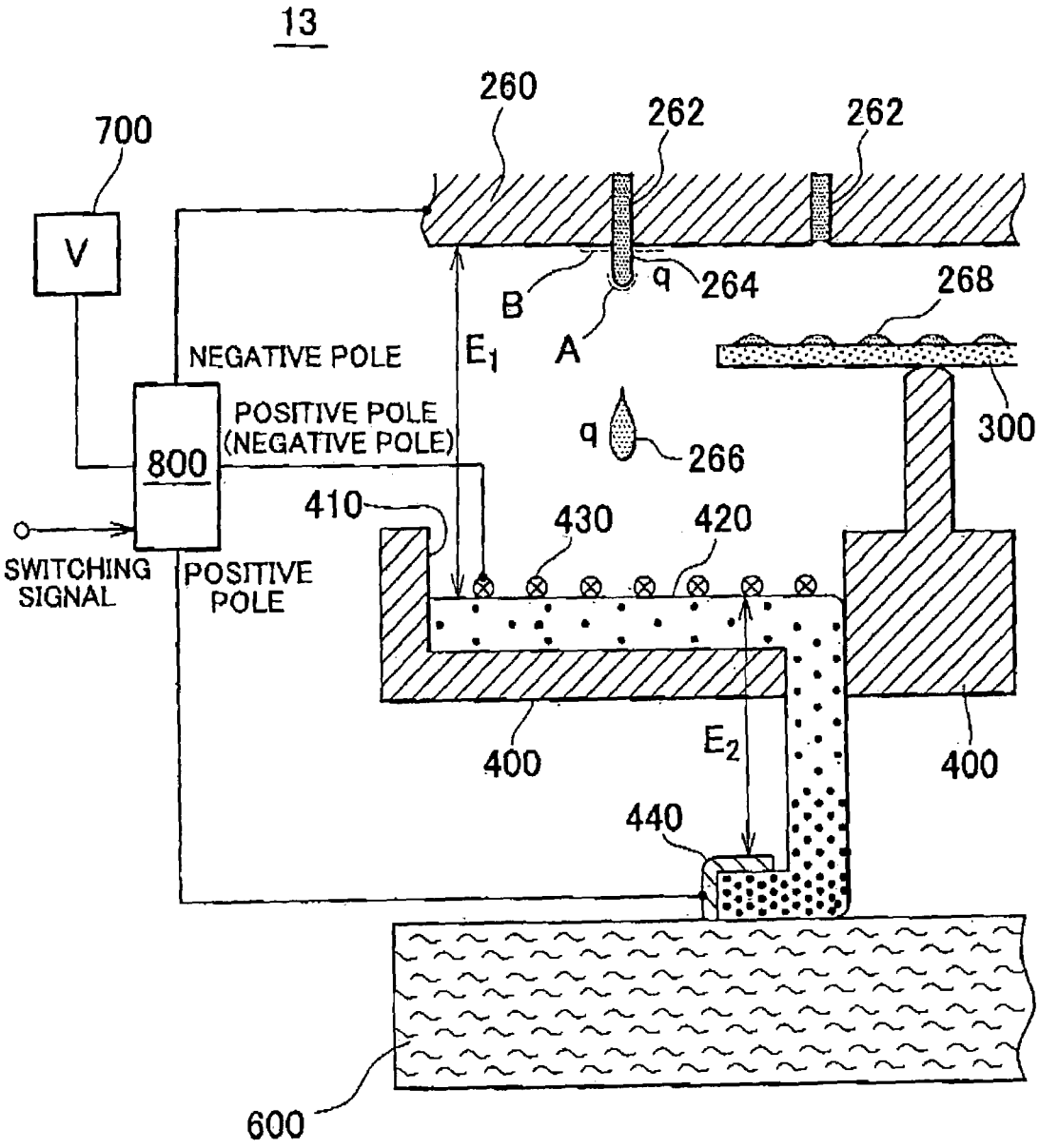
FIG. 10 is a schematic view showing another collecting mechanism 13 which can be implemented in the inkjet recording apparatus 11.

FIG. 10 is a schematic view showing the modification of the embodiment shown in FIG. 7. As shown in FIG. 10, the collecting mechanism 13 includes a single potential difference generating means 700 and a switching means 800 for switching the destination of the potential difference generating means 700 under the control of a switching signal. That is to say, the switching means 800 can selectively apply the potential difference V generated by the potential difference generating means 700 either of between the nozzle plate 260 and the absorbing surface side electrode 430, and between the absorbing surface side electrode 430 and the connecting surface side electrode 440. For the period while the recording head 210 operates and the ink is ejected from the nozzle plate 260 and the period immediately thereafter, the switching means 800 is shifted to a first state by the switching signal in order that the potential difference V is generated between the nozzle plate 260 and the absorbing surface side electrode 430. At this time, since the electric field El is generated between the nozzle plate 260 and the absorbing surface side electrode 430, aerosols are attracted to the absorbing member 420.

Next, when the ejection of ink has finished, the switching means 800 is shifted to a second state by the switching signal in order that the potential difference V is generated between the absorbing surface side electrode 430 and the connecting surface side electrode 440. At this time, since the electric field E2 is generated between the absorbing surface side electrode 430 and the connecting surface side electric field 440, the solute contained in the ink is moved to the connecting surface in the absorbing member 420, so that the solute is reduced on the absorbing surface.

As described above, the aerosol collecting operation and the solute moving operation are switchably performed by means of the single potential difference generating means 700. Therefore, the number of potential difference generating means is reduced so that the cost can be reduced, and also the electric power required for operating the inkjet recording apparatus 11 can be saved.

Figure 11:
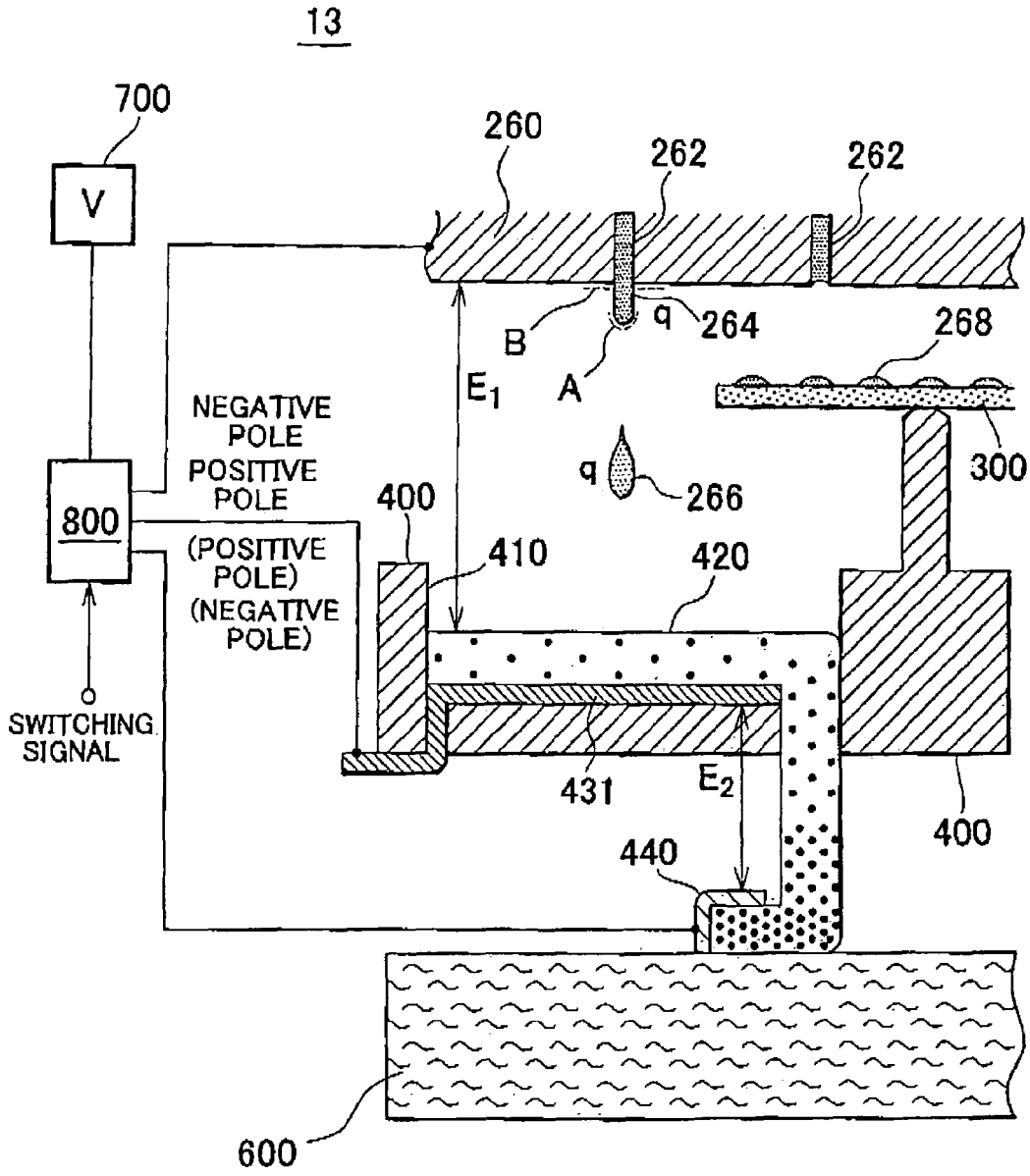
FIG. 11 is a schematic view showing another collecting mechanism 13 which can be implemented in the inkjet recording apparatus 11.

FIG. 11 is a schematic view showing the modification of the collecting mechanism 13 for, collecting the satellite ink and solute which is shown in FIG. 10. Here, components identical to the other drawings have been also marked with the same reference numerals, and the repeating description is omitted.

As shown in FIG. 11, the unique feature of the collecting mechanism 13 according to the present embodiment that an absorbing surface side electrode 431 formed with a conductive plate provided on the bottom of the concave portion 410 in the platen 400 is adjacent to the absorbing member 420 in the platen 400. In other words, the absorbing surface side electrode 431 is disposed on the rear surface of the plane facing the nozzle plate 260 of the absorbing member 420 in the present embodiment. Here, it is preferred that the material for the absorbing member 420 has conductivity. The other configuration is same as that of the embodiment shown in FIG. 10.

The absorbing surface side electrode 431 covers approximately all over the bottom of the concave portion 410 of the platen 400, and the absorbing member 420 of which shape is approximately same as the absorbing surface side electrode 431 is accommodated thereon in the present embodiment. Thus, the whole of the bottom surface of the absorbing member 420 is in contact with the absorbing surface side electrode 431, so that the absorbing member 420 and the absorbing surface side electrode 431 are electrically connected over a large area. Therefore, even if there is any section which is not electrically connected in the structure of the absorbing member 420, the potential of the whole absorbing member 420 is approximately same as that of the absorbing surface side electrode 431. Additionally, since the absorbing surface side electrode 431 is disposed on the rear surface of the absorbing member 420, any ink is not directly applied on the absorbing surface side electrode 431, so that the desired performance can be maintained for a long time.

Here, as for the material for the absorbing side electrode 431, a metal having corrosion resistance against the ink used for the inkjet recording apparatus 11, such as aurum, stainless or nickel can be used, for example. Additionally, an electrode member formed of the plate material made of those raw materials may be used. Further, a linear material or a foil material, or a meshed or a latticed member obtained by combining those materials may be used. Furthermore, a conductive coating layer, a plated layer, thick film layer and a thin film layer which are directly formed in the concave portion 410 of the platen 400 may be used.

For the period while the recording head 210 operates and the ink is ejected from the nozzle plate 260 and the period immediately thereafter, the switching means is shifted to a first state in order that the potential difference V is generated between the nozzle plate 260 and the absorbing surface side electrode 431 in the present embodiment as well as the former described embodiment. At this time, since the electric field E1 is generated between the nozzle plate 260 and the absorbing surface side electrode 431, aerosols are attracted to the absorbing member 420.

Next, when the ejection of ink has finished, the switching means 800 is shifted to a second state in order that the potential difference V is generated between the absorbing surface side electrode 430 and the connecting surface side electrode 440. At this time, since the electric field $E_2$ is generated between the absorbing surface side electrode 431 and the connecting surface side electric field 440, the solute contained in the ink moves to the connecting surface in the absorbing member 420, so that the solute is reduced on the absorbing surface.

As thus described above in detail, the inkjet recording apparatus 11 has a function for moving the solute contained in its absorbing member 420 to the waste liquid absorbing member 600 through electrophoresis. Therefore, the solute is not accumulated on the surface of the absorbing member 420, and the useless ink which is not used for recording the recording mediums 300 can be smoothly collected and disposed.

Here, a color ejection apparatus used for manufacturing color filters for a liquid crystal display, an electrode forming apparatus used for manufacturing an organic EL display and a FED (field emission display) or a sample ejection head used for manufacturing a biochip are taken for operative examples which can be used as embodiments of the present invention, however it is not limited to them.

While the present invention have been described with the embodiment, the technical scope of the invention not limited to the above described embodiment. It is apparent to persons skilled in the art that various alternations and improvements can be added to the above-described embodiment. It is apparent from the scope of the claims that the embodiment added such alternation or improvements can be included in the technical scope of the invention.

What is claimed is:

1. A liquid ejection apparatus comprising:

a liquid ejection head having a nozzle plate including openings, for ejecting liquid to a recording medium;

an absorbing member disposed further than the recording medium on the orbit of the liquid ejected from the nozzle plate and having an absorbing surface for absorbing the liquid which has not applied on the recording medium;

an waste liquid absorbing member having capillarity higher than that of the absorbing member and being in contact with the absorbing member on a connecting surface which is different from the absorbing surface, for sucking in the liquid which has been absorbed in the absorbing member; and a potential difference generating means for generating a potential difference between the absorbing surface and the connecting surface of the absorbing member and attracting the solute of the liquid from the absorbing surface to the connecting surface through electrophoresis.

2. The liquid ejection apparatus according to claim 1, wherein one end of the potential difference generating apparatus is connected to a connecting surface side electrode which is abutted on the absorbing member around the connecting surface to position the connecting surface.

3. The liquid ejection apparatus according to claim 1, wherein the other end of the potential difference generating apparatus is connected to an absorbing surface side electrode disposed adjacent to the absorbing surface.

4. The liquid ejection apparatus according to claim 1, wherein the other end of the potential difference generating apparatus is connected to the absorbing surface side electrode disposed adjacent to the rear surface of the absorbing surface.

5. The liquid ejection apparatus according to claim 1, wherein the other end of the potential difference generating apparatus is connected to the absorbing surface side electrode embedded into the absorbing member.

6. The liquid ejection apparatus according to claim 1 further comprising an external potential difference generating means for generating a potential difference between the nozzle plate and the absorbing surface of the absorbing member, and electrically attracting the liquid ejected from the nozzle plate to the absorbing surface.

7. The liquid ejection apparatus according to claim 6, wherein the nozzle plate has conductivity, and one end of the external potential difference generating means is connected to the nozzle plate.

8. The liquid ejection apparatus according to claim 6, wherein the other end of the external potential difference generating means is connected to the connecting surface side electrode which is abutted on the absorbing member around the absorbing surface to position the connecting surface.

9. The liquid ejection apparatus according to claim 6, wherein the other end of the external potential difference generating means is connected to the absorbing surface side electrode disposed adjacent to the absorbing surface.

10. The liquid ejection apparatus according to claim 6, wherein the other end of the external potential difference generating means is connected to the absorbing surface side electrode disposed adjacent to the rear surface of the absorbing surface.

11. The liquid ejection apparatus according to claim 6, wherein the potential difference generating means and the external potential difference generating means include individual potential difference generating circuits, respectively.

12. The liquid ejection apparatus according to claim 6, wherein, the potential difference generating means and the external potential difference generating means further comprising:

a single potential difference generating circuit;

a switching means for selectively switching a first connecting state in which an output of the potential difference generating circuit is coupled to the absorbing surface and the connecting surface of the absorbing member, and a second connecting state in which the output of the potential difference generating circuit is coupled to the nozzle plate and the absorbing member.

* * * * *